US006296194B1

(12) United States Patent
Hirota et al.

(10) Patent No.: US 6,296,194 B1
(45) Date of Patent: Oct. 2, 2001

(54) EXPANSION VALVE

(75) Inventors: Hisatoshi Hirota; Shinji Saeki; Isao Sendo; Masaichi Kawahata; Toshiyuki Shiota; Takashi Kobayashi, all of Tokyo (JP)

(73) Assignee: TGK Co., Ltd., Tokyo (JP)

( * ) Notice: Subject to any disclaimer, the term of this patent is extended or adjusted under 35 U.S.C. 154(b) by 0 days.

(21) Appl. No.: 09/480,278

(22) Filed: Jan. 10, 2000

(30) Foreign Application Priority Data

Jan. 13, 1999 (JP) ..... 11-005894
Sep. 3, 1999 (JP) ..... 11-249481
Sep. 28, 1999 (JP) ..... 11-273559

(51) Int. Cl.[7] ..... G05D 27/00
(52) U.S. Cl. ..... 236/92 B; 236/92 R
(58) Field of Search ..... 62/225; 236/92 B, 236/92 R

(56) References Cited

U.S. PATENT DOCUMENTS 5,303,864 * 4/1994 Hirota ..... 236/92 B
5,924,299 * 7/1999 Karl ..... 62/225
5,961,038 * 10/1999 Okada ..... 236/92 B

FOREIGN PATENT DOCUMENTS 09-222268 8/1997 (JP) .

* cited by examiner

*Primary Examiner*—William E. Tapolcal
*Assistant Examiner*—Mohammad M. Ali
(74) *Attorney, Agent, or Firm*—Nilles & Nilles SC

(57) ABSTRACT

An expansion valve adapted to achieve a stable operation in case of variations of the pressure of a high-pressure refrigerant is actuated by a power element transmitting an opening force to a valve body via a rod located between the power element and the power body by applying couple forces to the rod and generating a retarding force for the rod while the rod is guided in the direction of its shaft line

7 Claims, 12 Drawing Sheets

EXPANSION VALVE

BACKGROUND OF THE INVENTION

1. Field of the Invention refrigerant by controlling the flow rate of the refrigerant supplied to an evaporator in a refrigerating cycle, and according to the preamble part of claims 1 and 11.

In known expansion valves a valve body is arranged opposite to a valve seat formed by a thin contraction in the high-pressure refrigerant duct. Said valve body is moved in relation to said valve seat to open and close said valve seat corresponding to the temperature and the pressure of low-pressure refrigerant exiting the evaporator. The valve body is moved by an axially retractable rod which is guided along its shaft line in a penetration bore of the valve casing. Said rod is actuated by a power element operating corresponding to the temperature and the pressure of low-pressure refrigerant. In operation it may occur that due to some reasons the pressure of the high-pressure refrigerant supplied into the expansion valve significantly varies at the upstream side of the valve body. Said pressure variations are transmitted to the expansion valve body by means of the refrigerant medium. In case the pressure raises upstream the valve body due to a pressure variation, a pressure depending force acts on the valve body in its closing direction and consequently pushes said rod repeatedly. As a result, due to the closing or increasing throttling effect of the valve body the pressure of the refrigerants on the upstream side also is increasing and the occurring pressure variation even is multiplied. This might lead to an extremely unstable operation of the expansion valve.

2. Description of the Related Art

As disclosed in JP H 9-222 268 the operation of a known expansion valve was made stable by applying energy in lateral direction to the rod axially retractably disposed between the power element and the valve body, e.g. by a spring or the like. As a result, the valve body cannot respond as sensitively anymore to a variation of the pressure. However, the spring laterally pressing against the rod had to be made passive during a stable operation of the expansion valve and only should be set into action to stabilise the operation behaviour in case of pressure variations of the high-pressure refrigerant. As a result, the structure of the expansion valve became complicated as well as the assembling work, and the costs for manufacturing and assembling the expansion valve were high.

It is an object of the invention to provide an expansion valve performing a stabilised operation even in case of variations of the pressure of the high-pressure refrigerant and having an extremely simple and low cost design.

OBJECTS AND SUMMARY OF THE INVENTION

Said object is achieved by the features of claim 1 and an independent claim 11. Since the forces originating from the power element and applied to the rod held between the power element and valve body as well as for the valve body closing spring and even forces resulting from a pressure rise upstream of the valve body now are applied as couple forces, as a result, said forces applied to the rod from both its ends act to rotate or to bend the rod. Thus, a large frictional resistance occurs when the rod tends to slide axially. The valve body is disabled to respond too sensitively to a pressure change of the high-pressure refrigerant. Furthermore, it is possible to achieve said stable operational behaviour of the expansion valve by an extremely simple and cheap structure. During normal and stable operation of the expansion valve said couple forces may not gain significant influence. In other words, only in case that both ends of the rod are loaded by oppositely directed, significant forces said couple forces increase the sliding resistance of the rod temporarily in order to stabilise the operation. This is the consequential effect of the couple forces tending to rotate or bend or displace the rod sidewardly in firmer contact with the wall of said penetrating bore guiding the rod. The structure is simple and cheap, because the structural measures for the generation of the couple forces can easily be realised in the design of the expansion valve without complicating its design or the work necessary to assemble the expansion valve.

Preferred embodiments are disclosed in the depending claims.

DESCRIPTION OF THE PREFERRED EMBODIMENTS

Figure 1:
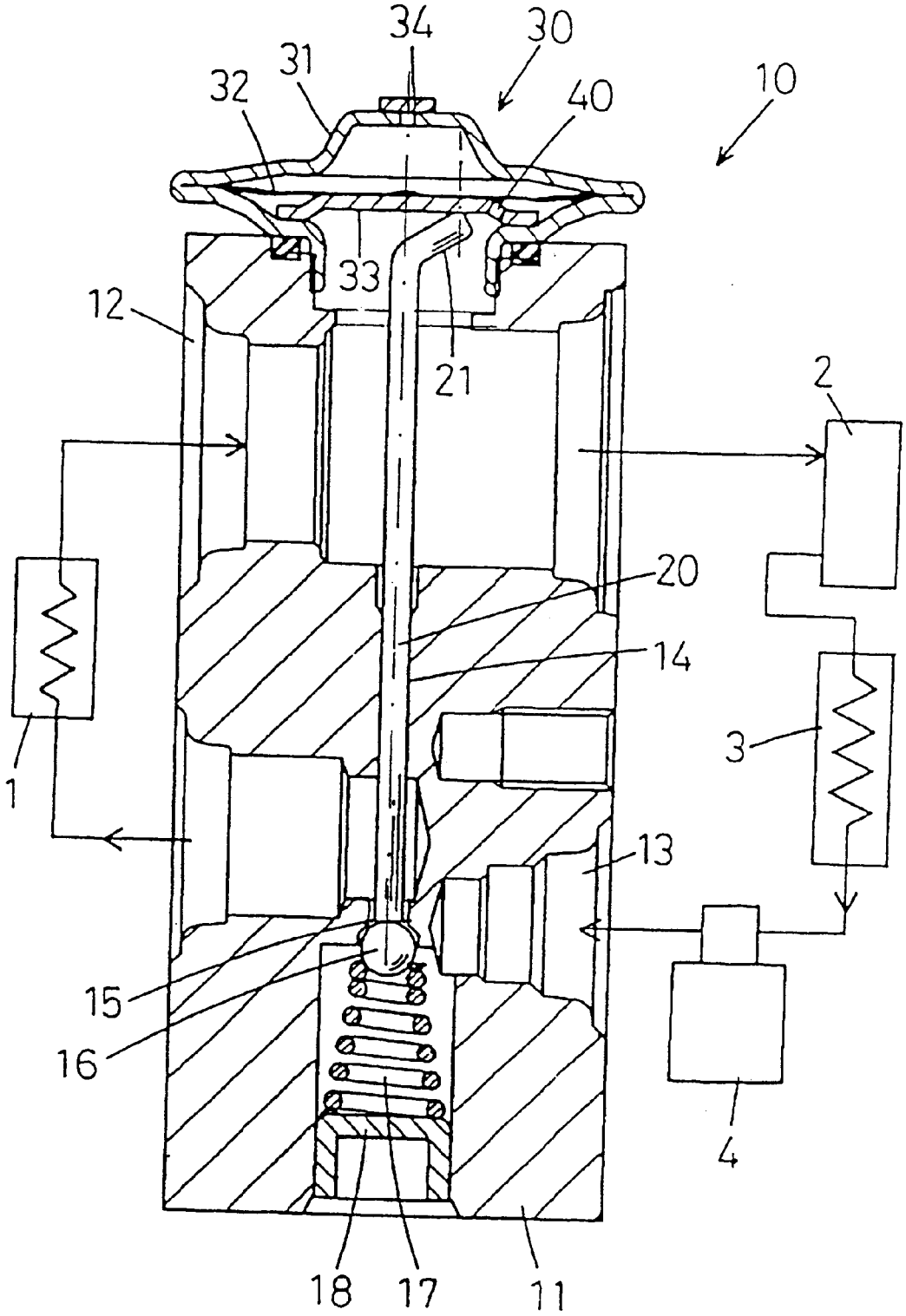
FIG. 1 is a longitudinal cross-section of the first embodiment of an expansion valve.

In FIG. 1 a refrigerant cycle, e.g. an air conditioning system for an automotive vehicle, comprises an evaporator 1, a compressor 2, a condenser 3, an accumulator 4 connected to the outlet of the condenser 3 and an expansion valve 10.

A valve casing 11 of the expansion valve 10 contains a low-pressure refrigerant duct 12 for passing low-temperature and low-pressure refrigerant gas as supplied from the evaporator 1 into the compressor 2 and a separate high-pressure refrigerant duct 13 for adiabatically expanding high-temperature and high-pressure refrigerant fluid supplied to the evaporator 1.

Ducts 12 and 13 are approximately parallel to another. Perpendicular to both ducts 12, 13 a penetrating bore 14 extends between both ducts 12, 13 in valve casing 11. Aligned with the penetrating bore 14 a power element 30 is installed into an opening of the valve casing 11. Said opening extends from duct 12 to the outer side of the valve casing 11.

Duct 13 is formed with a contraction in its middle portion so that a valve seat bore 15 is defined. In flow direction through duct 13 upstream of valve seat bore 15 a valve body 16 e.g. a spherical valve body, is associated to valve seat bore 15. Valve body 16 is pre-loaded in closing direction against valve seat bore 15 by a compression coil spring 17 held in place by a spring receiver 18.

Penetrating bore 14 receives rod 20 so that rod 20 is axially slidably guided in the direction of its shaft line. An upper end part of rod 20 reaches to the lower surface of power element 30. A middle part of rod 20 crosses duct 12 and is in engagement With penetrating bore 14. The lower end of rod 20 passes through valve seat bore 15 and contacts valve body 16. The diameter of rod 20 in its portion penetrating valve seat bore 15 is smaller than the inner diameter of valve seat bore 15.

Power element 30 is hermetically encapsulated by a housing 31 made of a thick metallic plate. Power element 30 contains a diaphragm 32, e.g. made of a flexible and thin metallic plate, e.g. of stainless steel with a thickness of e.g. 0.1 mm.

In an upper chamber of power element 30 a saturated vapour gas is contained which might be the same gas as is used as the refrigerant flowing through ducts 12 and 13. A plug 34 blocks a filling bore of power element 30.

Against the lower surface of diaphragm 32 a large diaphragm receiver 33, e.g. in the form of a plate, is disposed. The upper end part of rod 20 is contacting the lower surface of diaphragm receiver 33.

In order to transmit the actuating force of power element 30 to rod 20 by couple forces or by a momentum or bending momentum an upper end part 21 of rod 20 is slightly bent sidewardly, e.g. with an angle of about 60° in relation to the shaft line of rod 20. The, e.g. rounded end of end part 21 is contacting the lower surface of diaphragm receiver 33. As long as valve body 16 is not seated on valve seat bore 15 rod 20 is loaded from both ends by the force of power element 30 and force of valve closure spring 17. In the embodiment of FIG. 1 the central axis of diaphragm receiver 33 is aligned with an extension line of the shaft line of rod 20. A point where the force of power element 30 is applied onto rod 20 or its end parts 21 is laterally offset with respect to the central axis of diaphragm receiver 33.

Diaphragm receiver 33 has at least a refrigerant bore 40 controlling the transmission of low-pressure refrigerant to the lower surface of diaphragm 32 so that power element 30 is not affected by sudden temperature changes of the low-pressure refrigerant. If the temperature of the low-pressure refrigerant in duct 12 decreases, also the temperature of diaphragm 32 drops. The saturated vapour gas in power element 30 starts to condense on diaphragm 32. Consequently, the pressure in power element 30 drops and diaphragm 32 is displaced upwardly. Rod 20, loaded by compression coil spring 17, follows the motions of diaphragm 32. Valve body 16 moves towards valve seat bore 15 and reduces the cross-section for the high-pressure refrigerant flow. The flow rate of the refrigerant supplied to the evaporator 1 decreases. To the contrary, with raising temperature in duct 12 power element 30 presses down rod 20 moving valve body 16 away from valve seat bore 15. The flow rate of the high-pressure refrigerant supplied to the evaporator increases. Due to the bent end part 21 of rod 20 the forces applied from power element 30 and compression coil 17 to rod 20 act as couple forces tending to rotate or bend rod 20 in a direction changing the direction of the shaft line. Since rod 20 is guided by the inner wall of penetrating bore 14 while 17 moves in the direction of its shaft line, as a result, extreme or temporarily increased frictional resistance occurs between rod 20 and penetrating bore 14. In case that the pressure of the high-pressure refrigerant in duct 13 is varied, rod 20 due to the retarding sliding resistance does not sensitively respond. The switching operation of valve body 16 is stabilised.

Figure 2:
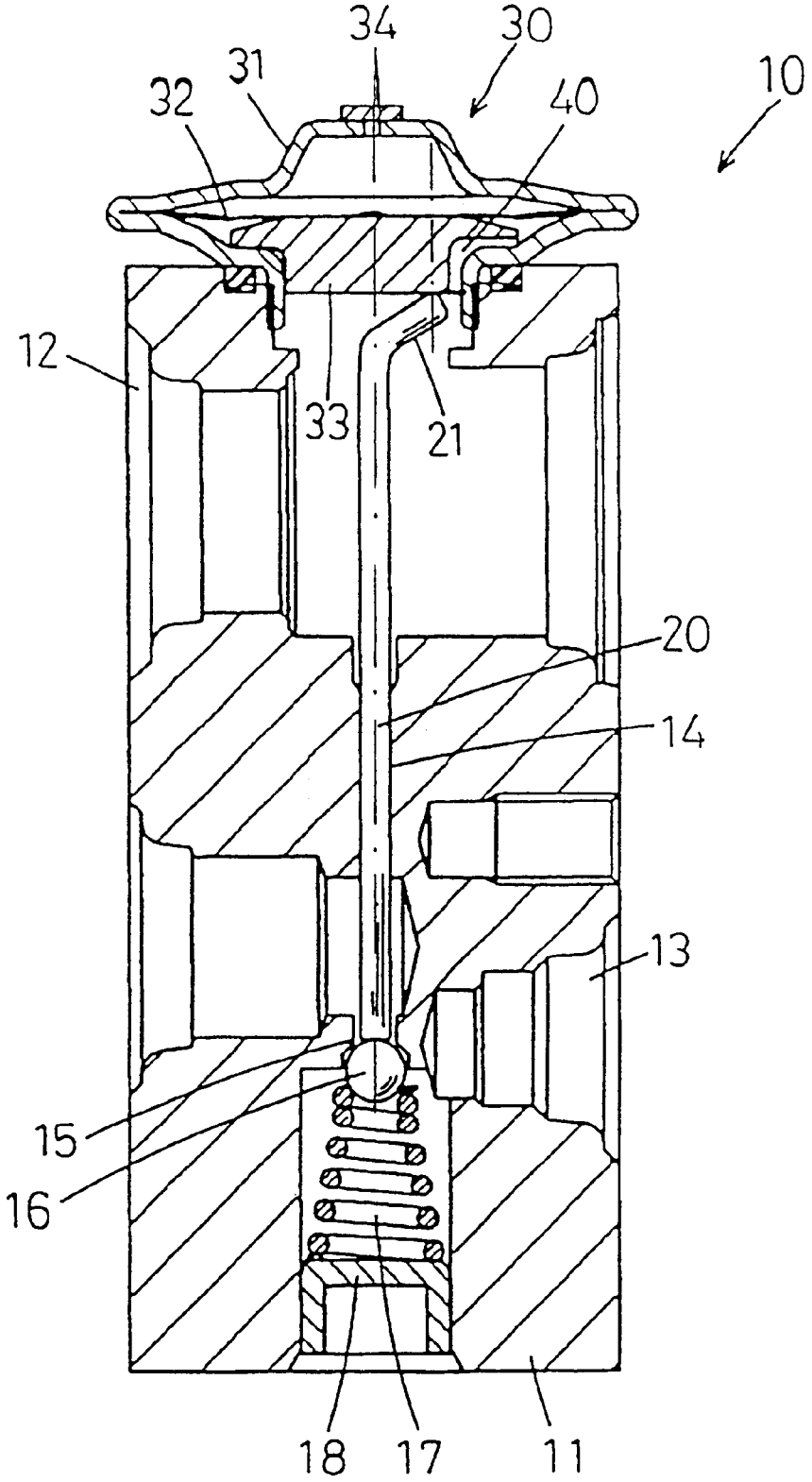
FIG. 2 is a longitudinal section of a second embodiment of an expansion valve.

In the second embodiment of the expansion valve 10 in FIG. 2 the diaphragm receiver 33 contacted by end part 21 of rod 20 is made of thick plastic material with low thermal conductivity.

Figure 3:
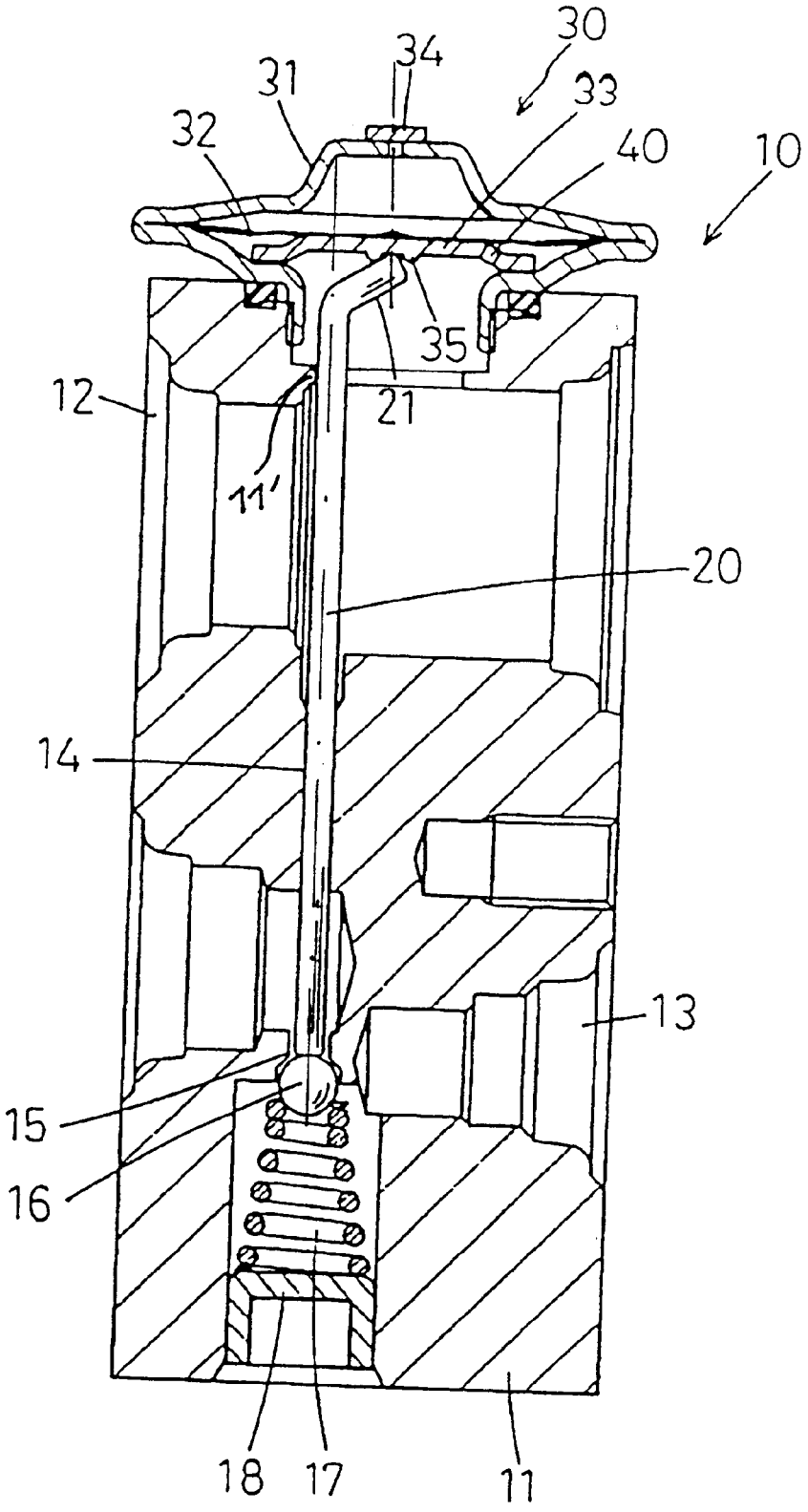
FIG. 3 is a longitudinal section of a third embodiment of an expansion valve.

In the third embodiment of the expansion valve 10 of FIG. 3 slightly bent end part 21 of rod 20 contacts diaphragm receiver 33 at the position of its central axis. However, the shaft line of rod 20 as well as penetrating bore 14 are laterally offset with respect to the central axis of power element 30. At the centre of the lower surface of diaphragm receiver 33 a circular concave part 35 is formed receiving the tip of bent end part 21. Between the opening of valve casing 11 containing housing 31 of power element 30 and duct 12 a guiding projection 11' is formed for additionally guiding and laterally supporting rod 20.

Figure 4:
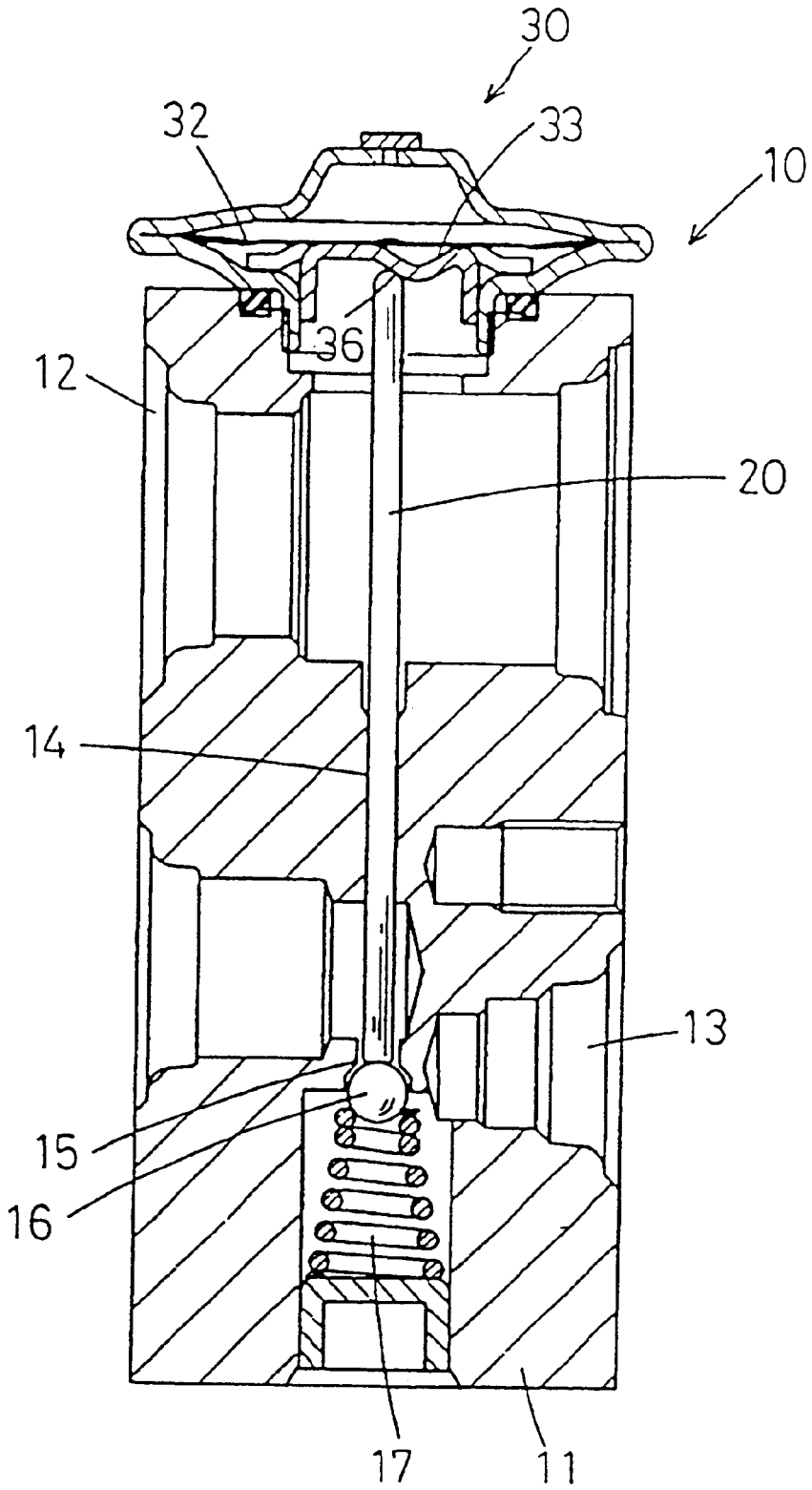
FIG. 4 is a longitudinal section of a fourth embodiment.

In the fourth embodiment of expansion valve 10 in FIG. 4 rod 20 is straight such that its upper end part is in line with its shaft line. The central axis of power element 30 is aligned with the shaft line of rod 20 as well. However, a misalignment between the central axis of power element 30 and shaft line of rod 20 also would be tolerable. Diaphragm receiver 33 is formed with a slanted abutment surface 36 contacting the upper, in this case rounded, tip of rod 20. Said tip can be smoothly rounded or may have another shape like the shape of a cone or other kinds of shapes. Due to the slanted or inclined abutment surface 36 the force applied by power element 30 to rod 20 is forming couple forces.

Figure 5:
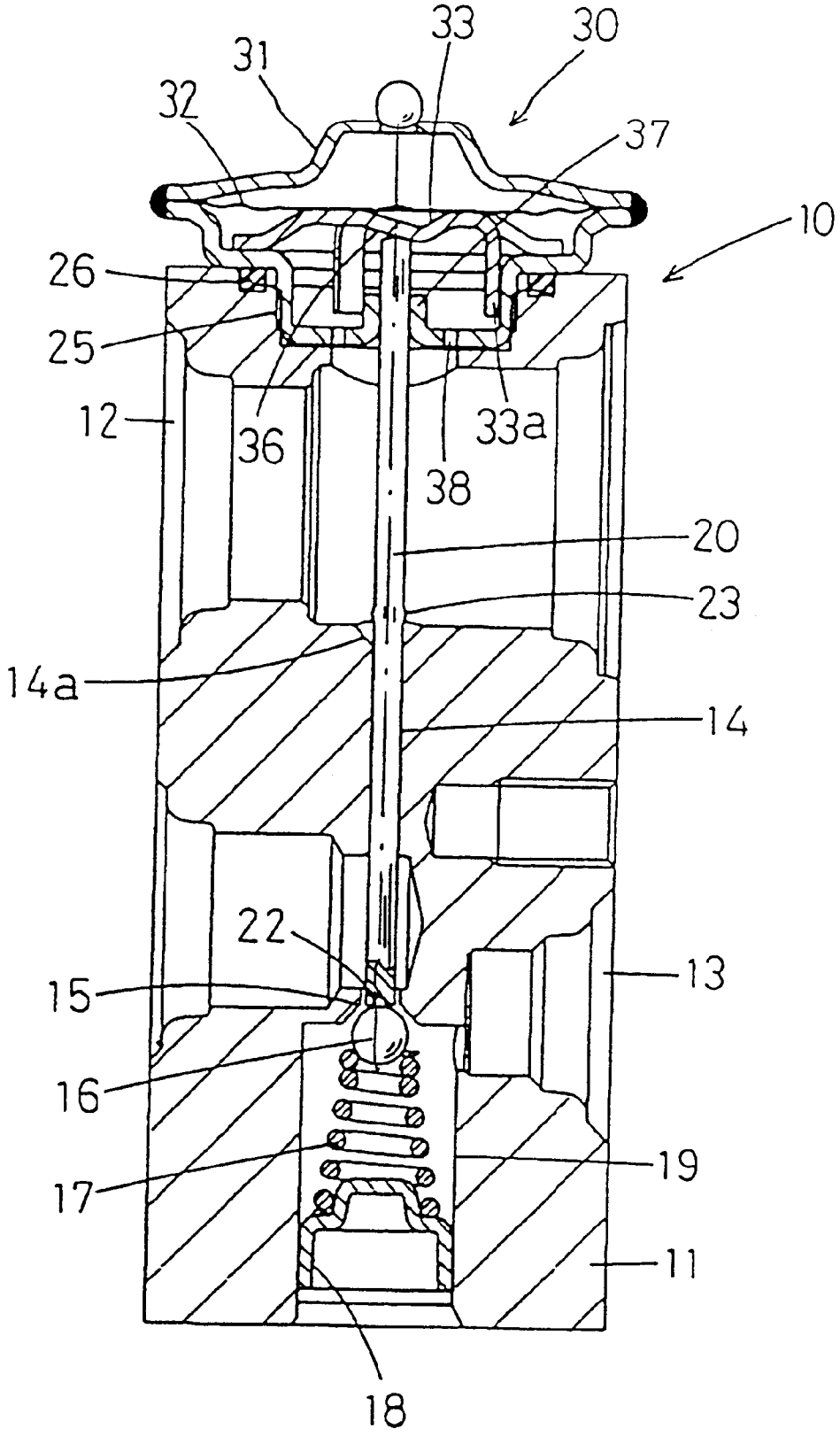
FIG. 5 is a longitudinal section of a fifth embodiment.

In the fifth embodiment of expansion valve 10 of FIG. 5 further improvements are provided. Valve body 16 can be made of metal, and is, e.g. a stainless steel balls. The mouth of valve seat bore 15 can be conical. Compression coil spring 17 has a tapering shape such that its winding diameter is gradually decreasing towards valve body 16. Spring 17 is made of metal like stainless steel. Valve body 16 may be directly fixed to the end winding of spring 17 by welding or the like. Due to this, valve body 16 cannot be lost from spring 17 during assembling. Furthermore, valve body 16 and spring 17 are easy to recycle in case that both their materials have the same quality. Spring receiver 18 of spring 17 is housed in a bore 19 the axis of which is aligned with the axis of valve seat bore 15. Spring receiver 18 is press-fitted in bore 19. Preparation of the fixation of spring receiver 18 does not create chips, because a threaded connection is avoided. Spring receiver 18 is of cylindrical form and has an inner closed end surface. The fixing position of spring receiver 18 is adjusted when assembling the expansion valve such that the spring force of compression coil spring 17 has a proper value. In order to secure airtightness for spring receiver 18 without using a seal means like an O-ring, a screw-lock or welding or the like can be used instead. The airtight fixation also could be achieved by a spring back effect when using a spring material for the spring receiver 18.

Figure 6:
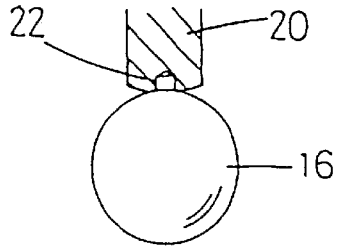
FIG. 6 is a partial cross-section of a variation of the fifth embodiment.
Figure 7:
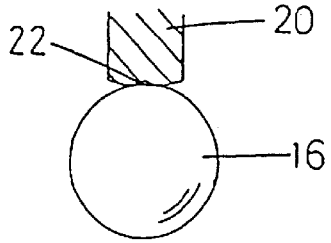
FIG. 7 is a partial cross-section of a second variation of the fifth embodiment.

The lower end of rod 20 has a V-shaped or similarly shaped concave depression 22 where rod 20 is contacting valve body 16. As a result, valve body 16 does not lose contact with rod 20 and does not create vibration sound. Concave depression 22 can be, e.g. as shown in FIGS. 6 and 7, with a U-shape or a V-shape and a smaller diameter than the outer diameter of rod 20.

In FIG. 5 the engagement length between rod 20 and penetrating bore 14 may be about 10 to 15 mm or more. The clearance of rod 20 in penetrating bore 14 is about 0.01 to 0.12 mm so that rod 20 is controlled to be loose. Said slide fit also controls or suppresses vibration sounds generated by valve body 16.

Rod 20 is provided with a projecting part 23 higher up than an opening part 14*a* of penetrating bore 14 in duct 12. Projecting part 23 can be formed by crushing or squeezing rod 20 laterally. Projecting part 23 hinders that rod 20 can slide down through penetrating bore 14. This holds rod 20 stably during assembly. Opening part 14*a* can be shaped conically.

All parts of power element 30 can be made, e.g. of the same metallic material like stainless steel. When disassembling expansion valve 10 it is possible to recycle removed power element 30.

Figure 8:
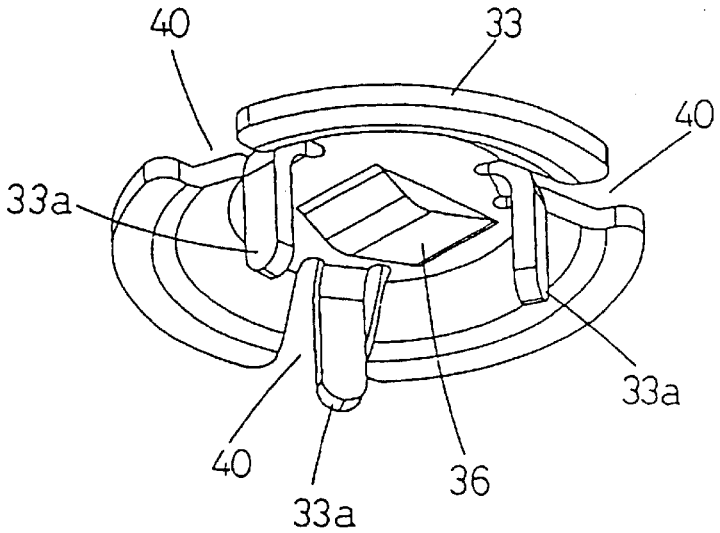
FIG. 8 is a perspective view of a detail of the fifth embodiment.
Figure 9:
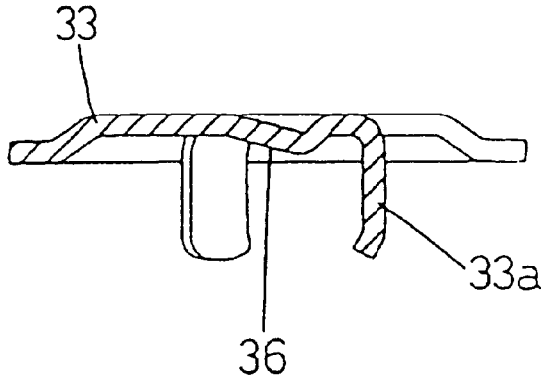
FIG. 9 is a longitudinal section of a further variation of the fifth embodiment.

As a variation of the fifth embodiment in FIG. 8 diaphragm receiver 33 is a plate having three leg parts 33*a* formed by bending. Diaphragm receiver 33 can be produced by pressing a board material. Slanted or inclined abutment surface or slope 36 is formed at the central portion of diaphragm receiver 33. The angle of surface 36 in relation to the plane of diaphragm 32 lies within a range of about 5° to 25°0. If said angle would be larger or too large, the sliding force is increased and hysteresis might occur. A too small angle would lead to a negative effect. Leg parts 33*a* have to stabilise the posture of or have to guide diaphragm receiver 33 along an inner surface of housing 31 of power element 30. Furthermore, by bending leg parts 33*a* downwardly from the plane of diaphragm receiver 33 notches are created serving as refrigerant ducts 40. As shown in FIG. 9 the lower tips of leg parts 33*a* can be bent inwardly. Said measure avoids that leg parts 33*a* can be caught at the inner guiding surface of housing 31. The movement of diaphragm receiver 33 in the direction of the shaft line of rod 20 becomes smoother.

Figure 10:
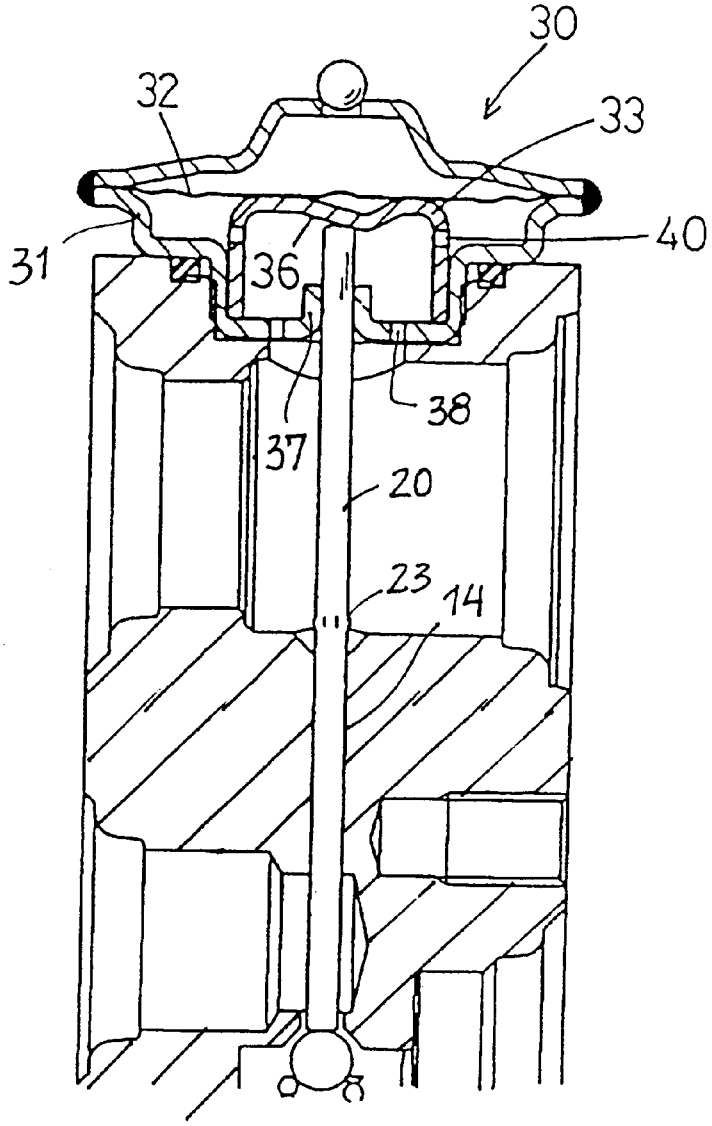
FIG. 10 is a longitudinal section of a further variation of the fifth embodiment.
Figure 11:
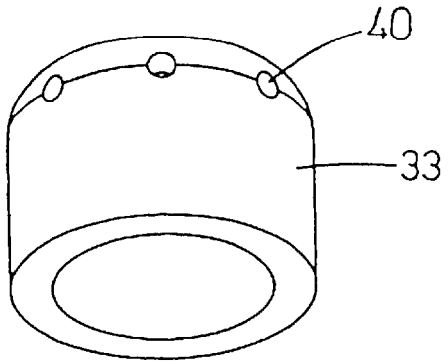
FIG. 11 is a perspective view of a variation of a detail of the fifth embodiment.

In FIGS. 10 and 11 diaphragm receiver 33 is formed as a cap. Refrigerant duct 40 is formed as a small diameter bore.

Figure 12:
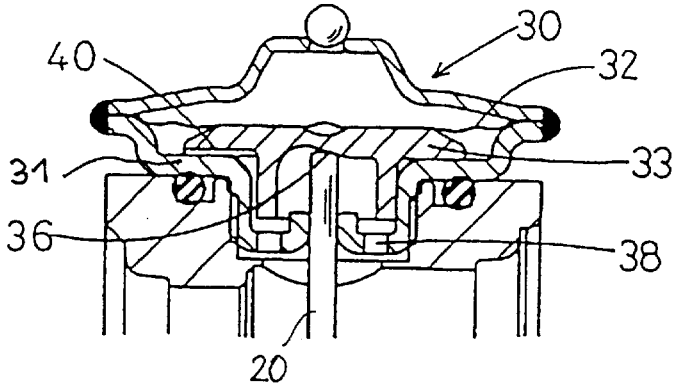
FIG. 12 is a longitudinal section of a further variation of a detail of the fifth embodiment.
Figure 13:
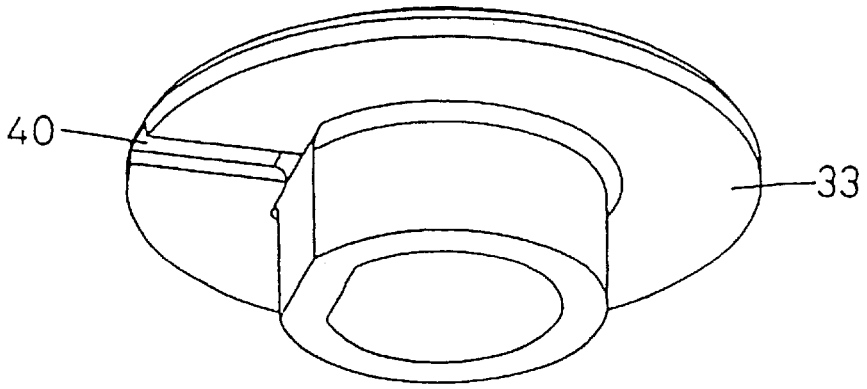
FIG. 13 is a perspective view of the further variation of the detail of the fifth embodiment.

In FIGS. 12 and 13 diaphragm receiver 33 is formed as the head of a rivet by forging or the like. The refrigerant duct 40 is formed as a groove in the lower surface of said rivet head and a flattened portion in the collar of diaphragm receiver 33 used to guide the linear motion of diaphragm receiver 33. FIG. 12 shows that housing 31 of power element 30 has a bottom defining a guiding bore or guiding collar for the upper end part of rod 20 engaging at rod 20 distant from slanted or inclined surface 36 in the direction of the shaft line. Additional bores 38 allow the entrance of low-pressure refrigerant into housing 31 and further along duct 40 to the lower side of diaphragm 32. A similar design is shown in FIG. 5, already.

In FIG. 5 housing 31 is formed with an engaging part 25 for engagement with the inner wall of the opening in valve casing 11. Engaging part 25 forms a guiding collar 37 for the upper end part of rod 20 spaced apart in the direction of shaft line of rod 20 from inclined surface 36. A sealing means 26 below housing 31 and in a groove of valve casing 11 can be used as well. Guiding collar or rod receiver 37 slidably engages rod 20 in order to control the slide fit of rod 20 and to avoid the generation of noise. Bores 38 in the bottom of housing 31 are provided for passing refrigerant with a small flow rate to the diaphragm 32 of power element 30. Due to these variations of temperature and pressure of the refrigerant are transmitted slowly to diaphragm 32. Therefore, the operation of expansion valve 10 does not change suddenly.

Figure 14:
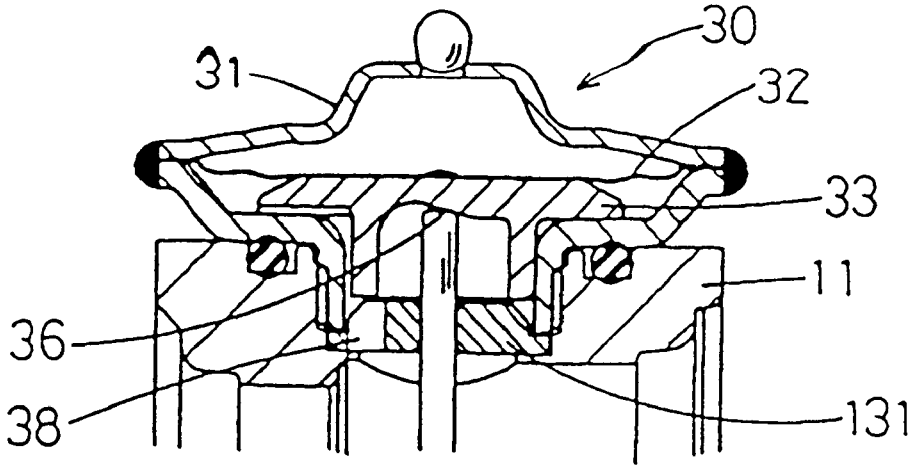
FIG. 14 is a longitudinal section showing a further variation of details of the fifth embodiment.

In FIG. 14 a bushing 131, e.g. made of plastic or the like, is held between power element 30 and valve casing 11. Bushing 131 is provided with bore 38.

Figure 15:
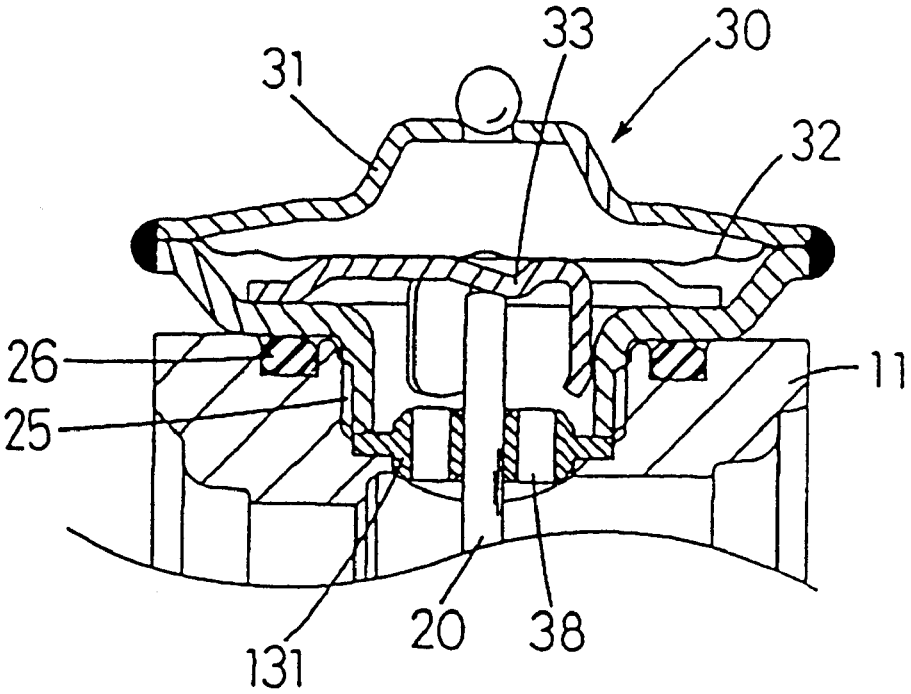
FIG. 15 is a longitudinal section showing a further variation of a detail of the fifth embodiment.

In FIG. 15 a symmetrical bushing 131 is provided as a middle part between power element 30 and the bottom of the opening receiving housing 31 of power element 30. Due to the symmetrical shape of bushing 131 it can be assembled in any position facilitating assembling.

Figure 16:
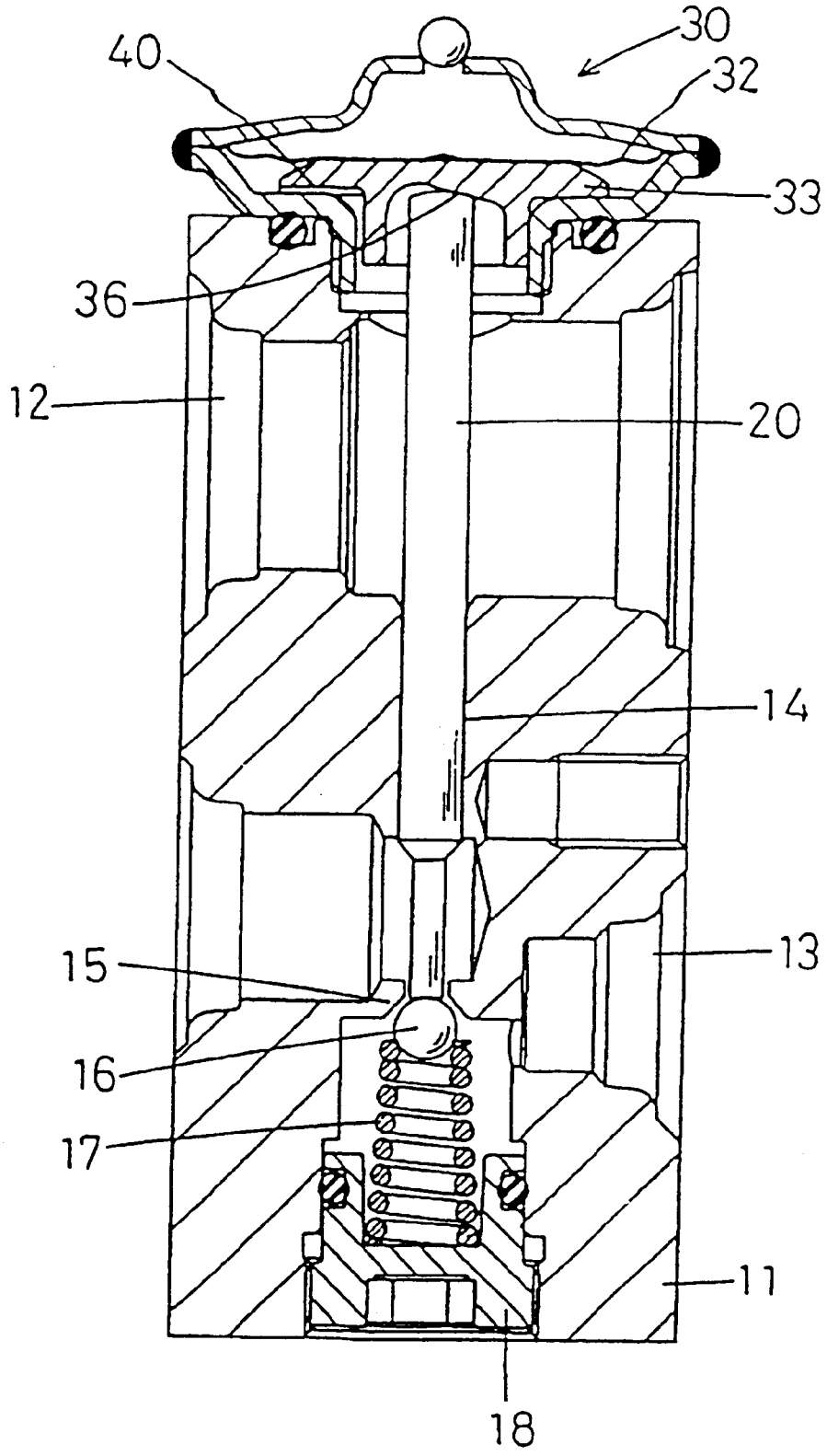
FIG. 16 is a longitudinal section of a sixth embodiment.

In the embodiment of FIG. 16 rod 20 is formed as a thickened pole in its portion extending through penetrating bore 14 and further upward to inclined surface 36. Spring receiver 18 in this case is installed by a threaded connection in valve casing 11.

Figure 17:
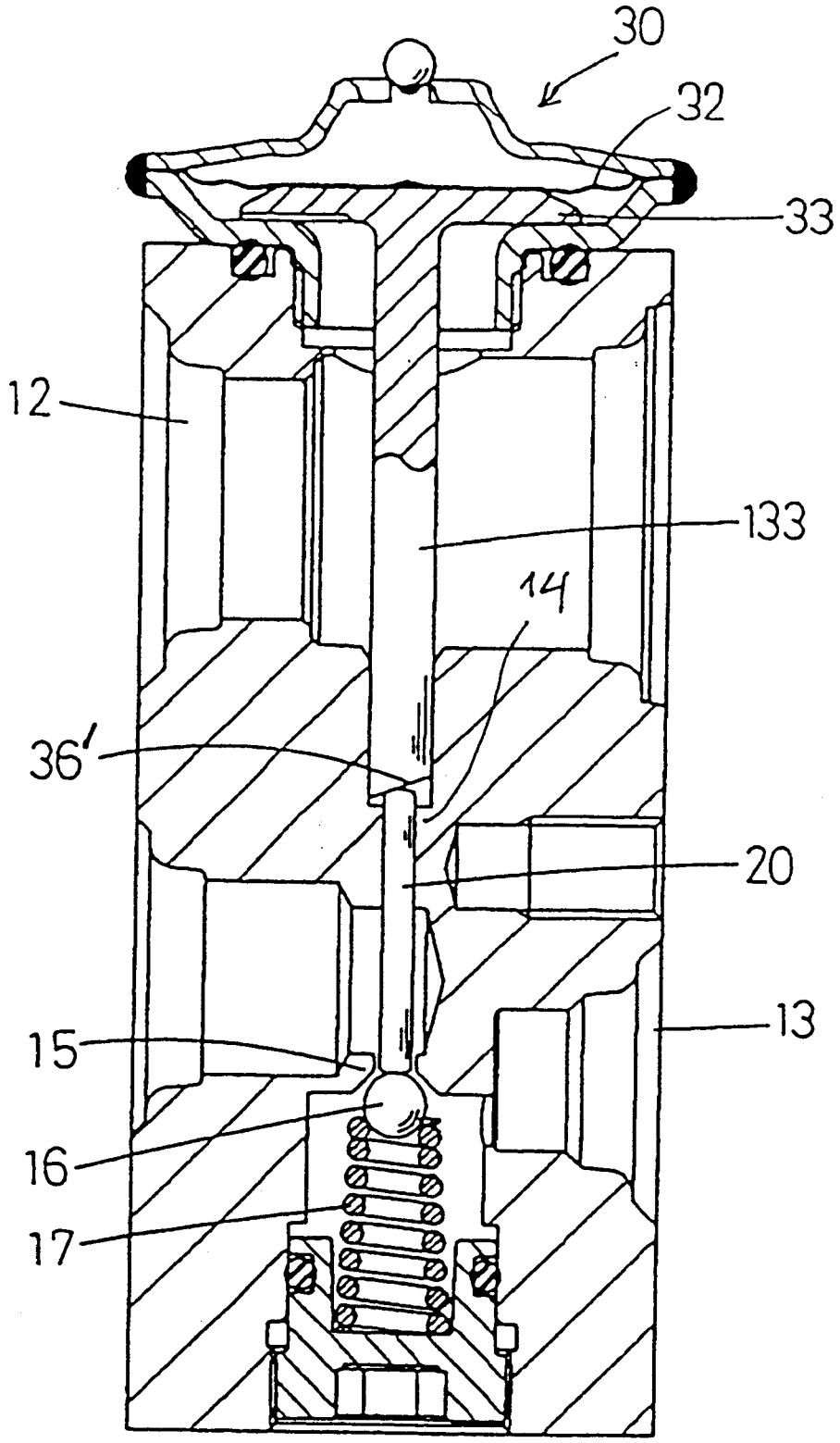
FIG. 17 is a longitudinal section of a seventh embodiment.

In the embodiment of FIG. 17 rod 20 is short and extends only slightly into an upper widened portion of penetrating bore 14. A thicker pole-shaped straight part 133 the shaft line of which is aligned with the shaft line of rod 20 or is in parallel line with it, extends through said widened portion and between the upper end of rod 20 and diaphragm receiver 33. In FIG. 17 part 133 is unitary with diaphragm receiver 33. The lower end surface of part 133 contacting the upper end of rod 20 is formed as a slope or inclined surface 36'. Forces transmitted between rod 20 and part 133 generate respective laterally directed forces due to inclined surface 36'. Said forces increase the sliding resistance of rod 20 and/or part 133 in penetrating bore 14.

Figure 18:
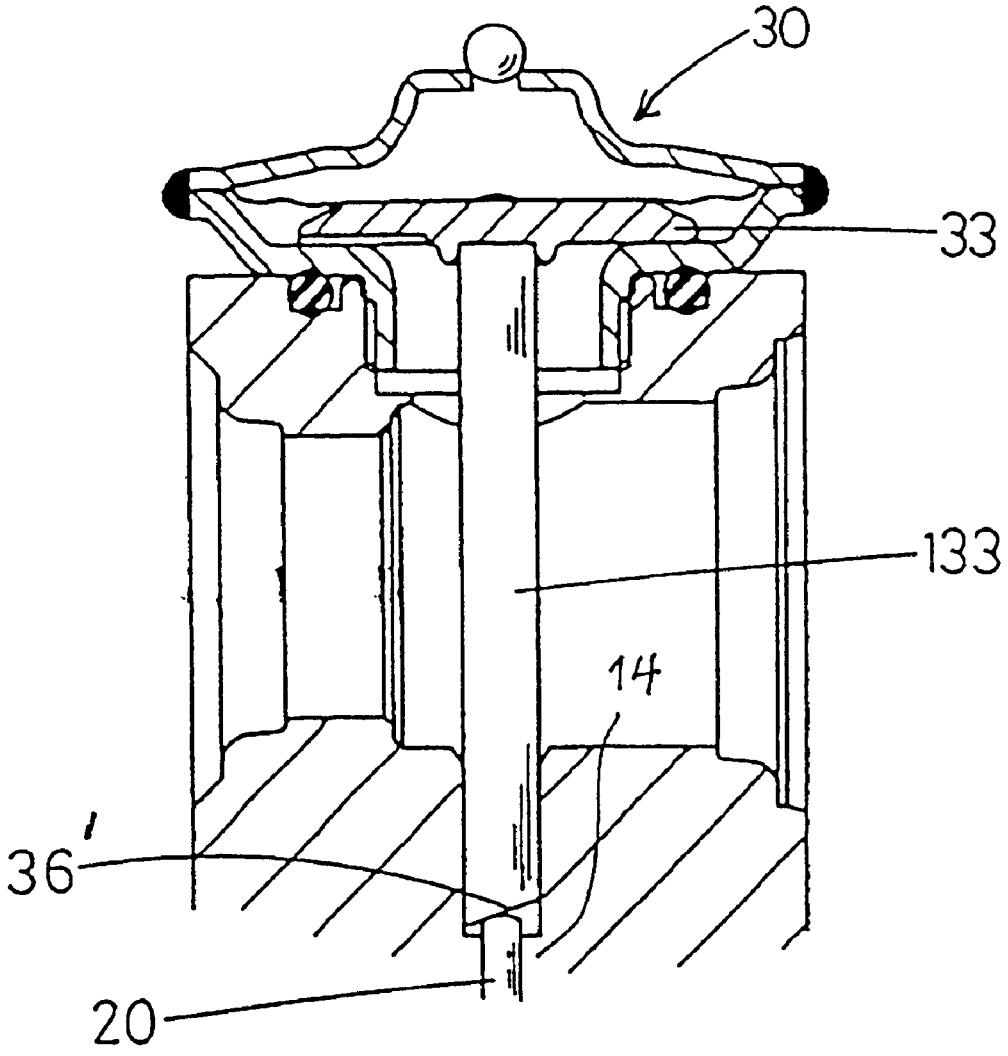
FIG. 18 is a longitudinal section of an eighth embodiment of an expansion valve.

In the embodiment of FIG. 18 thicker pole-shaped part 133 is made of a material different from the material of diaphragm receiver 33. Part 133 can be connected with diaphragm receiver 33 via a socket provided at the lower surface of diaphragm receiver 33.

According to the invention the forces acting on both ends of rod 20 cause a longitudinal compression of said rod 20. Due to the lateral offset between the point where the force of the power element is transmitted to the upper end of rod 20 and the shaft line where the rod is guided in penetrating bore 14 or in the guiding collar 37 and where the force of valve body 16 is applied, the sliding resistance of said rod at least temporarily is increased due to intentionally created lateral retarding forces. Temporarily means that this effect mainly takes place when the upwardly directed force of valve body 16 increases due to a pressure variation upstream of valve body 16 to then stabilise the operation behaviour of the expansion valve 10. During normal operation said retarding forces need not necessary affect the operation. However, even during normal operation the stabilising effect can be used.

What is claimed is:

1. An expansion valve for refrigerating cycle comprising:

a valve casing containing a high-pressure refrigerant duct and a separate low-pressure refrigerant duct;

a valve seat bore formed within the high-pressure refrigerant duct;

a valve body associated with the valve seat bore, wherein the valve body moves between a blocking position seated on the valve seat bore and an opening position lifted away from the valve seat bore;

a rod aligned at one end with the valve body, wherein the rod is retractably guided in the direction of a center axis of the rod within a penetrating bore of the valve casing, wherein the rod includes a free end facing the power element, wherein the free end of the rod defines a first abutment surface and prolongs a straight rod portion received within the penetrating bore;

a power element stationarily provided within the valve casing in flow and pressure connection with the low-pressure refrigerant duct, wherein the power element axially displaces the rod by a force corresponding with the temperature and/or the pressure of refrigerant passing through the low-pressure refrigerant duct;

wherein the power element includes a pressure responsive diaphragm and a diaphragm receiver movable within a housing of the power element in response to pressure-related diaphragm motions, wherein a lower surface of the diaphragm defines a second abutment surface;

wherein first and second abutment surfaces mutually contact each other at a common contact point; and wherein one of the first and second abutment surfaces is rounded and the other of the first and second abutment surfaces is obliquely inclined in relation to the center axis of the rod.

2. The expansion valve according to claim 1, wherein the rounded abutment surface is convex.

3. The expansion valve according to claim 1, wherein the obliquely inclined abutment surface is located at the diaphragm receiver.

4. The expansion valve according to claim 1, wherein the obliquely inclined abutment surface is located at the lower surface of said diaphragm receiver.

5. The expansion valve according to claim 1, wherein said diaphragm receiver includes a pole-shaped straight part protruding coaxially with the center axis of the rod from the lower surface of the diaphragm receiver towards the free end of the rod, and wherein the obliquely inclined abutment surface is provided at a free end of the pole-shaped straight part.

6. The expansion valve according to claim 1, wherein a straight pole-shaped part extends coaxially with the center axis of the rod between the diaphragm receiver and the free end of the rod, and wherein the obliquely inclined abutment surface is provided at a free end of said pole-shaped straight part facing said free end of the rod.

7. The expansion valve according to claim 1, wherein the diaphragm receiver comprises at least one refrigerant passing bore for slowed down transmission of temperature of the refrigerant in the low-pressure refrigerant duct to the power element.

* * * * *